US012741779B2

(12) United States Patent
Jiang et al.

(10) Patent No.: US 12,741,779 B2
(45) Date of Patent: Sep. 22, 2026

(54) PACKAGING BOX AND CARDBOARD STRUCTURE

(71) Applicant: ShenZhen YUTO Packaging Technology Co., Ltd., Shenzhen (CN)

(72) Inventors: Zhanfeng Jiang, Shenzhen City (CN); Zhiyong Ding, Shenzhen (CN)

(73) Assignee: ShenZhen YUTO Packaging Technology Co., Ltd., Shenzhen (CN)

( * ) Notice: Subject to any disclaimer, the term of this patent is extended or adjusted under 35 U.S.C. 154(b) by 315 days.

(21) Appl. No.: 18/389,747

(22) Filed: Dec. 19, 2023

(65) Prior Publication Data

US 2024/0351736 A1 Oct. 24, 2024

(30) Foreign Application Priority Data

Apr. 19, 2023 (CN) ..... 202320928833.9

(51) Int. Cl.
*B65D 5/32* (2006.01)
*B65D 5/42* (2006.01)

(52) U.S. Cl.
CPC ..... *B65D 5/32* (2013.01); *B65D 5/42* (2013.01)

(58) Field of Classification Search
CPC .. B65D 25/106; B65D 25/107; B65D 5/4204; B65D 5/5038; B65D 77/0413; B65D 77/042
USPC ..... 206/738, 739, 763, 485, 486, 779, 472; 229/120.011, 120.01, 87.07, 904
See application file for complete search history.

(56) References Cited

U.S. PATENT DOCUMENTS 2,018,861 A * 10/1935 Mertz ..... B65D 5/5007 206/823
3,159,273 A * 12/1964 Schecterson ..... B65D 5/5286 206/45.28
3,656,612 A * 4/1972 Sellors ..... B65D 5/5007 229/120.08
5,407,076 A * 4/1995 Sabet ..... B65D 5/509 206/472
6,213,389 B1 * 4/2001 Cai ..... B65D 5/4802 229/917
2008/0018095 A1 * 1/2008 Garett ..... B65D 5/427 283/67
2021/0179315 A1 * 6/2021 Rykal ..... B65D 5/643

OTHER PUBLICATIONS

R L Shirley & Company LTD (Year: 1949).*

* cited by examiner

*Primary Examiner* — Nathan J Newhouse
*Assistant Examiner* — Nina K Attel
(74) *Attorney, Agent, or Firm* — Arch & Lake LLP; Hao Tan; Shen Wang

(57) ABSTRACT

Provided are a packaging box and cardboard structure. The packaging box includes: a first box body including a first plate body and sidewall parts, where the first plate body includes a first opening, two ends of the first plate body along a first direction and two ends of the first plate body along a second direction are respectively connected with the sidewall parts, a portion of the sidewall parts parallels to a third direction, where the first, the second and the third directions are mutually perpendicular. The packing box further includes a second box body including a first receiving part in bending connection with a second receiving part. The first box body and the second box body are in two states.

18 Claims, 9 Drawing Sheets

PACKAGING BOX AND CARDBOARD STRUCTURE

CROSS-REFERENCE TO RELATED APPLICATIONS

This application is based upon and claims priority to Chinese Patent Application No. 202320928833.9, filed on Apr. 19, 2023, the entire content of which is incorporated herein by reference for all purposes.

BACKGROUND

The packaging boxes currently common in the market have a single function. After the user receives the product, the packaging box has no further usage. Some of packaging boxes are discarded, causing certain pollution to the environment, and some are collected, but the purpose of collection is to recycle the packaging box materials. Therefore, the service life of the packaging box with a single function ends after the packaging and transportation of the product, and it is difficult to make further uses.

SUMMARY

The present disclosure relates to the technical field of packaging box manufacturing, and in particular to a packaging box and cardboard structure. To overcome the problems existing in the related art, the present disclosure provides a packaging box and cardboard structure.

According to a first aspect of the present disclosure, a packaging box is provided. The packaging box includes: a first box body including a first plate body and a plurality of sidewall parts; where the first plate body includes a first opening, two ends of the first plate body along a first direction and two ends of the first plate body along a second direction are respectively connected with the plurality of the sidewall parts; a portion of the sidewall parts parallels to a third direction, where the first direction, the second direction and the third directions are mutually perpendicular; and a second box body including a first receiving part in bending connection with a second receiving part. Furthermore, in a first state, the second box body is located inside the first box body and blocks the first opening; in a second state, the first receiving part and the second receiving part are respectively connected to outside of the first plate body and an inner portion of the first box body is exposed through the first opening.

According to a second aspect of the present disclosure, a cardboard structure includes: a first surface and a second surface that is opposite to the first surface; where a first sub-board is bent to form a first box body, including a first plate area and a plurality of sidewall areas; where the first plate area along a first reference direction and a second reference direction are respectively connected to the plurality of the sidewall areas; the first plate area is provided with a first opening; the sidewall area is bent at least toward the first surface relative to the first plate area to form a first plate body and sidewall parts; the first reference direction and the second reference direction are perpendicular; a second sub-board is bent to form a second box body, comprising a first accommodating area and a second accommodating area mutually connected, where the first accommodating area is bent to form a first receiving part, and the second accommodating area is bent to form a second receiving part; where in a first state, the second box body is located inside the first box body, blocking the first opening; in a second state, the first receiving part and the second receiving part are respectively connected to outside of the first plate body, and an inner portion of the first box body is exposed through the first opening.

It should be understood that the above general description and the following detailed description are only exemplary and explanatory, and cannot limit the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the present disclosure.

DETAILED DESCRIPTION

Figure 1:
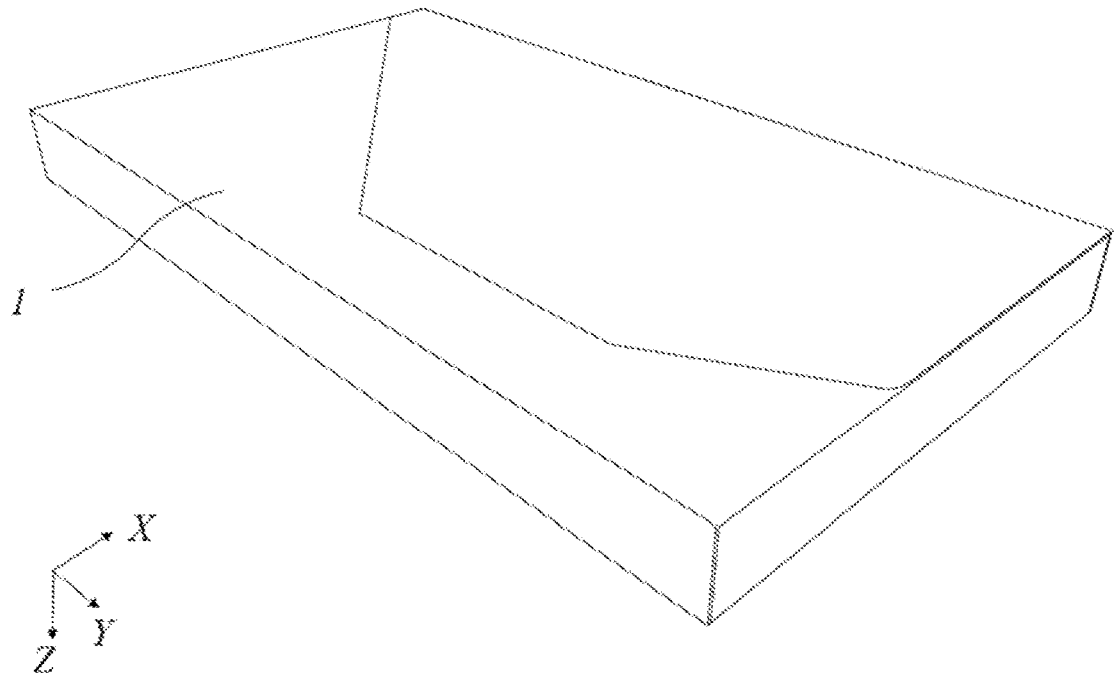
FIG. 1 is a schematic diagram of the packaging box in the first state according to some examples of the present disclosure.

Examples will be described in detail herein, examples of which are illustrated in the accompanying drawings. When the following description refers to the drawings, the same numbers in different drawings refer to the same or similar elements, unless otherwise indicated. The implementations described in the following illustrative examples are not representative of all implementations consistent with the present disclosure. Rather, they are merely examples of devices and methods consistent with aspects of the present disclosure as detailed in the appended claims.

It should be noted that in this article, the terms "include," "includes" or any other variations thereof are intended to mean non-exclusive inclusion, so that a process, method, article or device including a series of elements not only those elements and also includes other elements not expressly listed or elements inherent in a process, method, article, or device. Without further limitation, provided by the statement "includes an element . . . " does not exclude the inclusion of the identical element in the process, method, article or device. In addition, there are components with the same names in different examples of the present disclosure. Characteristics and elements may have the same meaning or may have different meanings, and their specific meanings must be based on their context. The explanations in the specific examples may be further determined in conjunction with the context of the specific examples.

It should be understood that although the terms first, second, third, etc. may be used herein to describe various information, this information should not be limited to these terms. These terms are only used to distinguish information of the same type from each other. For example, without departing from the scope of this application, the first information may also be called the second information, and similarly, the second information may also be called the first information. Depends on the context, as used here the word "if" can be interpreted as "at" or "when" or "in response to determination". Furthermore, as used in this application, the singular forms "a," "an" and "the" are intended to include the plural forms as well, unless the context dictates otherwise. It should be further understood that the terms "comprising" and "including" indicate the presence of stated features, steps, operations components, assemblies, items, categories, and/or groups, but not to the exclusion of the existence, occurrence, or addition of one or more operations, elements, components, items, categories, and/or groups. The words "or" and "and/or" are to be construed as inclusive or to mean any one or any combination. Therefore, "A, B or C" or "A, B and/or C" means "any of the following: A; B; C; A and B; A and C; B and C; A, B and C". Exceptions to this definition only occur when the combination of elements, functions, steps or operations inherently interact with each other are mutually exclusive in some manner. In describing the structure of a component, when referring to a layer or area is said to be "on" or "above" another layer or area, it can mean that it is directly located on another layer or another area, one area contains other layers or areas on top of it, or between it and another layer or area. And if the part is turned over, that layer, one area, will be "beneath" or "below" another layer, another area. In some examples of this disclosure, "B corresponding to A" means that B is associated with A and B can be determined according to A. But it should also be understood that determining B based on A does not mean determining B based solely on A, B can be determined based on A and/or other information.

It should be understood that the specific examples described here are only used to explain the present disclosure and are not used to limit this disclosure.

In the following description, suffixes such as "module," "component" or "unit" used to represent elements are used. The suffixes are only used to facilitate the description of the present disclosure and have no specific meaning in themselves. Therefore, "module," "component" or "unit" can be used mixedly.

The packaging box usually only has basic packaging functions. After opening the packaging box, there are usually three ways of subsequent utilization. Most packaging boxes are for one-time use, and after being opened, the packaging boxes will be abandoned and become packaging waste, which is likely to cause environmental pollution or resource waste. Part of packaging boxes are also for one-time use. Although the opened packaging boxes are also discarded, the materials used to make them will be recycled. This will also cause certain pollution and waste of resources. There are also some packaging boxes that can be reused. But it is basically still used for packaging, so its reuse is subject to certain limitations.

In view of the above analysis, the present disclosure provides a packaging box and cardboard structure. In the present disclosure, cardboard may refer to any paper-based material including paperboard. The packaging box includes a first box body and the second box body. In the first state, the second box body is loaded into the first box body, and the packaged items may be placed in the first receiving part and the second receiving part of the second box body, so that the first box body and the second box body may provide double layer of protection for packaged items. In the second state, the second box may be taken out from the first box and bent to connect to the first plate body of the first box body, so that the first receiving part, the second receiving part and the first opening can hold and display the packaged items, making it convenient to access and store the packaged items during use. Packaging box has a variety of functions and can be used in a variety of scenarios, expanding the application scope of packaging boxes, thereby making the packaging box easier to reuse and more environmentally friendly.

Figure 2:
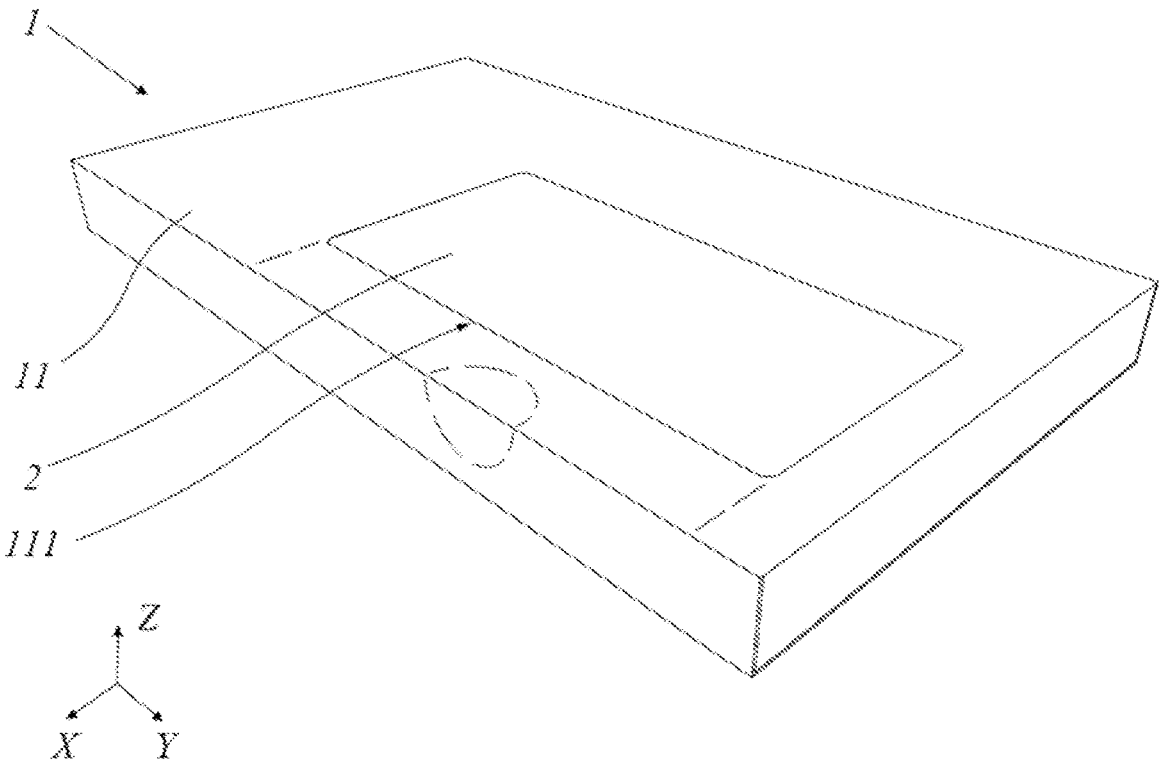
FIG. 2 is another schematic diagram of the packaging box in the first state according to some examples of the present disclosure.
Figure 3:
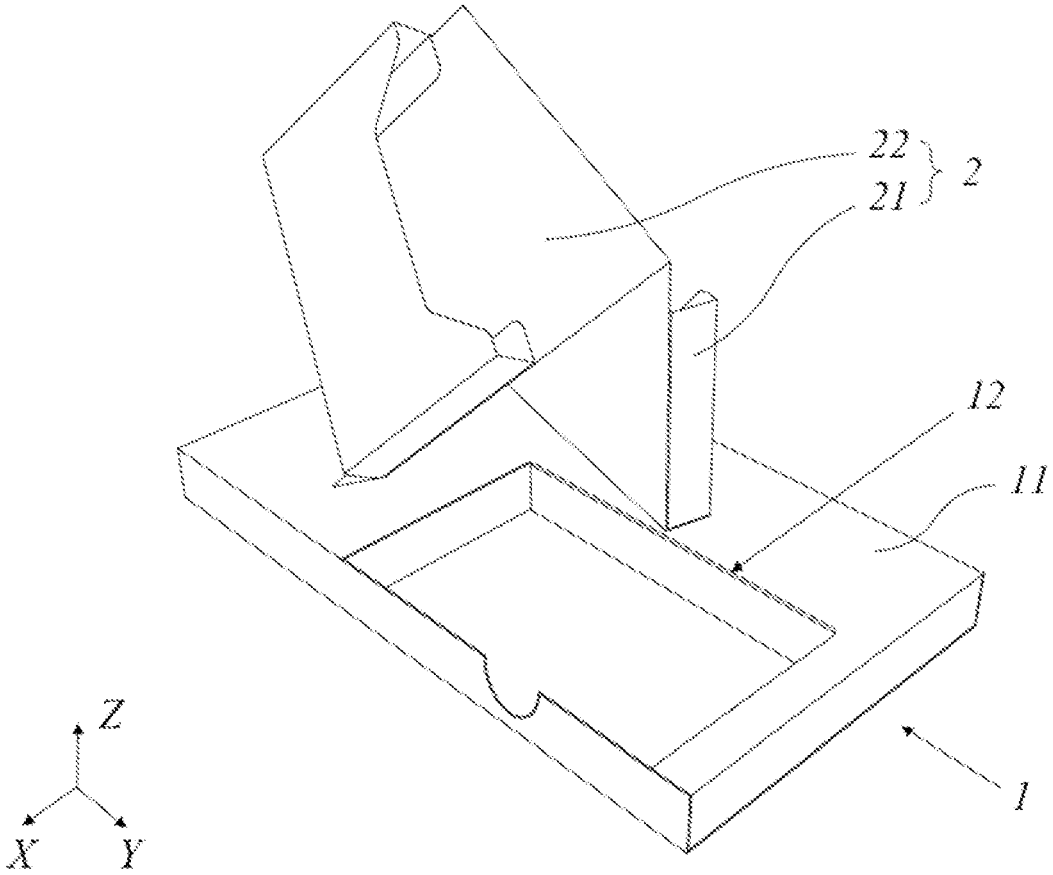
FIG. 3 is a schematic diagram of the packaging box in the second state according to some examples of the present disclosure.

FIG. 1 is a schematic diagram of the packaging box in the first state according to some examples of the present disclosure. FIG. 2 is another schematic diagram of the packaging box in the first state according to some examples of the present disclosure. FIG. 3 is a schematic diagram of the packaging box in the second state according to some examples of the present disclosure.

Referring to FIGS. 1 to 3, an example of the present disclosure provides a packaging box, including: a first box body I which includes a first plate body 11 and a plurality of sidewall parts; the first plate body 11 is provided with a first opening 111, and both ends of the first plate body 11 along the first direction X and the two ends along the second direction Y are respectively bendably connected to, i.e., bent and connected to, a plurality of sidewall parts; a part of the sidewall part is parallel to the third direction Z; the first direction X, the second direction Y and the third direction Z are mutually perpendicular to each other; the second box body 2 includes a first receiving part 21 and a second receiving part 22 connected by bending, i.e., in bending connection. The packaging box also includes a first state and a second state; in the first state, the second box body 2 is located inside the first box body 1, and the second box body 2 blocks the first opening 111; in the second state, the first receiving part 21 of the second box body 2 and the second receiving part 22 are both connected to the outside of the first plate body 11, and the inner portion of the first box body 1 is exposed through the first opening.

In some examples of the present disclosure, the first direction X, the second direction Y and the third direction Z are perpendicular to each other. When the packaging box of some examples of the present disclosure is placed on the water, the first direction X and the second direction Y may be two perpendicular horizontal directions, and the third direction Z is the vertical direction. The packaging box of examples of the present disclosure may also be to be placed on a plane or curved surface that is inclined relative to the horizontal.

When the packaging box of examples of the present disclosure is in the first state, the packaging box of examples of the present disclosure has the packaging function and can be used to contain packaged items. When the packaging box of examples of the present disclosure is in the second state, the packaging box of examples of the present disclosure has display and storage functions, it can be used to display and store the packaged items.

The first box body 1 is used as the main carrying structure of the packaging box in some examples of the present disclosure. In the first state, the first box body 1 forms the outer layer of protection of the packaging box in some examples of the present disclosure. Besides, its own structural characteristics, combined with the first box body 1, can also provide a certain buffer for the packaged items. In the second state, the second box body 2 is taken out from the first box body 1, so that the first opening 111 of the first box body 1 is exposed, and the interior of the first box body 1 forms a receiving space, and the packaged items can be placed in through the first opening 111 to facilitate the user to store or take out the packaged items. Besides, the user can check the packaged items through the first opening 111 for the purpose of displaying the packaged items. Furthermore, in the first state, the second box body 2 blocks the first opening 111, which can reduce the possibility of the packaged items being lost from the first opening 111.

The second box body 2 is used as the main structure of the packaging box in some examples of the present disclosure to accommodate the packaged items. In the first state, the packaged items can be placed in the first receiving part 21 and the second receiving part 22 of the second box body 2, and then put the second box body 2 together with the packaged items into the first box body 1, and the second box body 2 forms the inner layer protection of the packaging box in some examples of the present disclosure. Besides, combined with the structural characteristics of the second box body 2, it can also provide a certain buffer for the packaged items, thereby further improving the packaging performance of some examples of the present disclosure. In the second state, the second box body 2 is taken out from the first box body 1, packaged items can be placed in the first receiving part 21 and the second receiving part 22 respectively. After the first receiving part 21 and the second receiving part 22 is relatively bent, it is connected to the first plate body 11 of the first box body 1, so that the first receiving part 21 and the second receiving part 22 are inclined relative to the first plate body 11 and can be simplified into a triangular structure. That is, in the second state, the first receiving part 21 and the second receiving part 22 are inclined relative to the first direction X. The packaged items can be more fully displayed, and it is also more convenient for users to take or store the packaged items.

In the first state and the second state, the first box body 1 and the second box body 2 of the packaging box according to some examples of the present disclosure are connected in different ways to form a whole, so that the packaging box of some examples of the present disclosure has packaging function in the first state, and display and storage function in the second state. Therefore, the packaging box of some examples of this disclosure can be used in a variety of scenarios, expanding the application scope of the packaging box, making the packaging box easier to be reused and more environmentally friendly.

Figure 4:
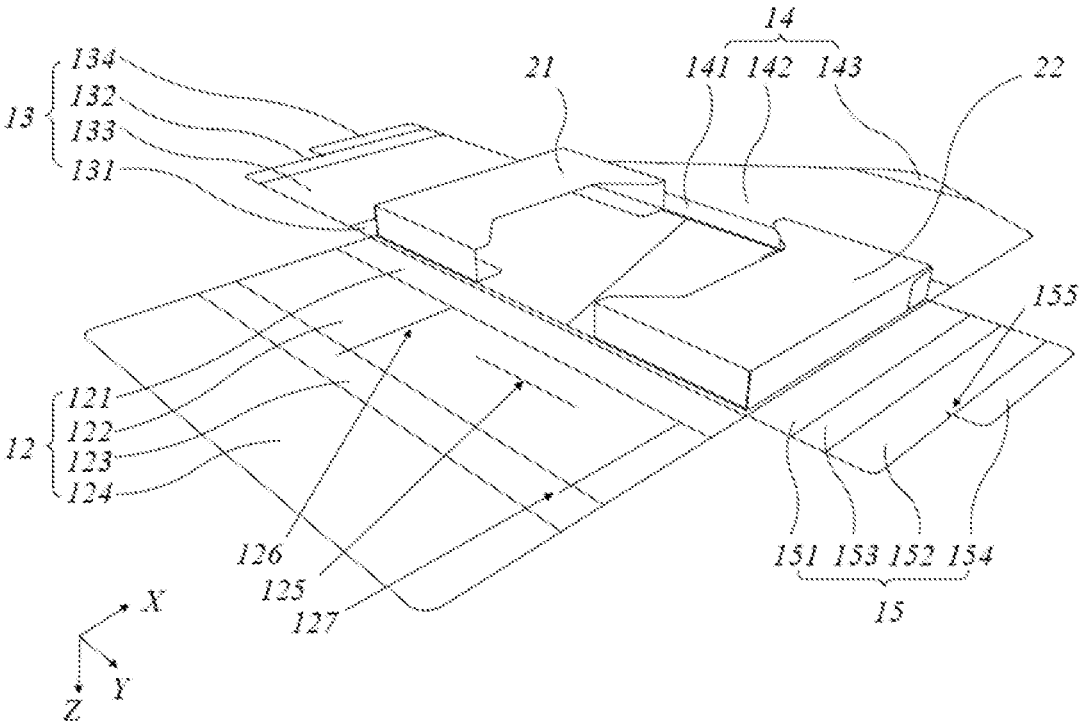
FIG. 4 is an expanded schematic view of the packaging box according to some examples of the present disclosure.
Figure 5:
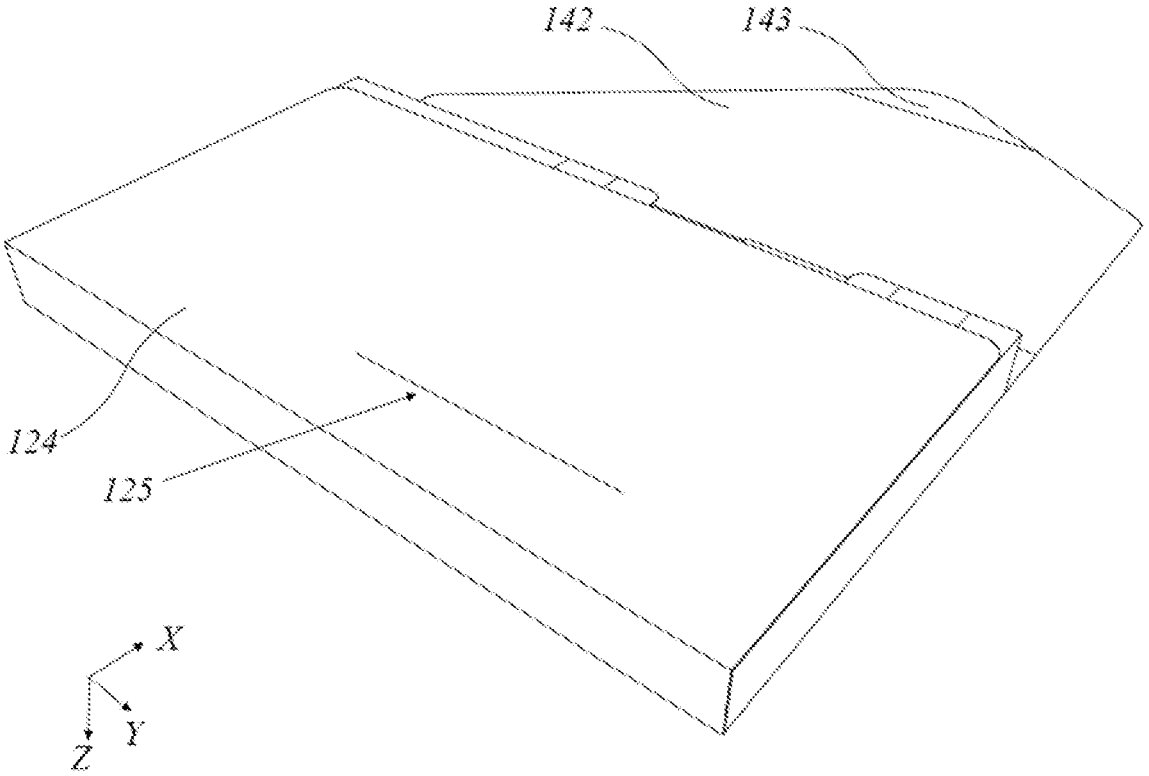
FIG. 5 is another expanded schematic view of the packaging box according to some examples of the present disclosure.
Figure 6:
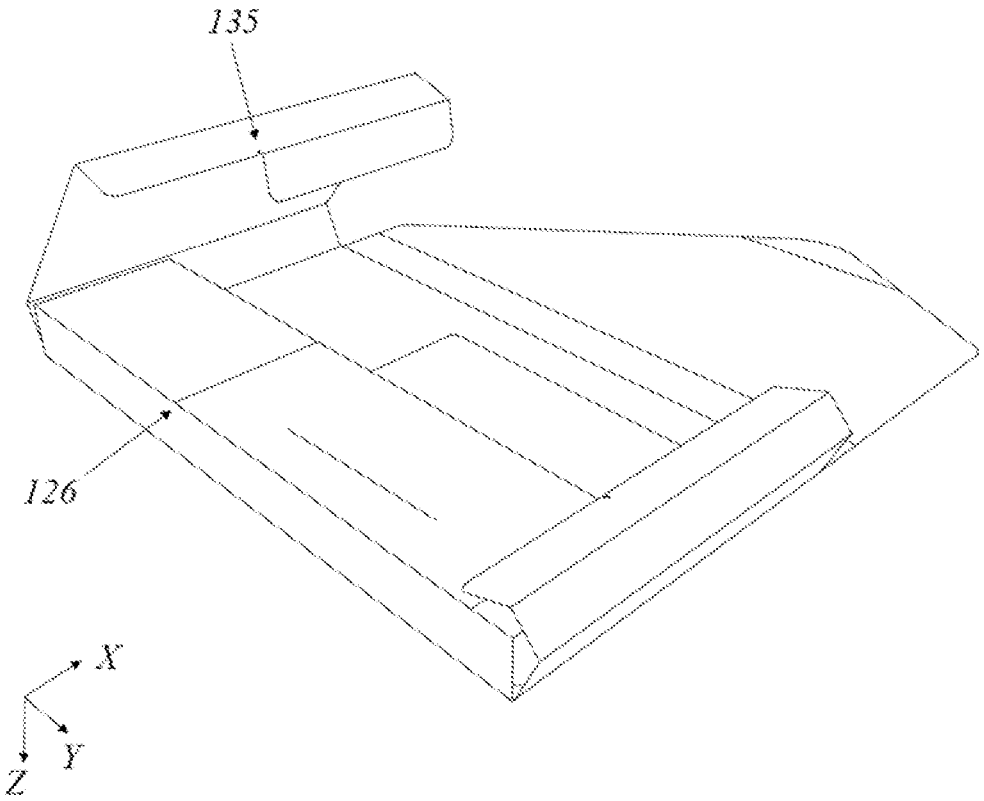
FIG. 6 is an expanded schematic view of the first box body of the packaging box according to some examples of the present disclosure.
Figure 7:
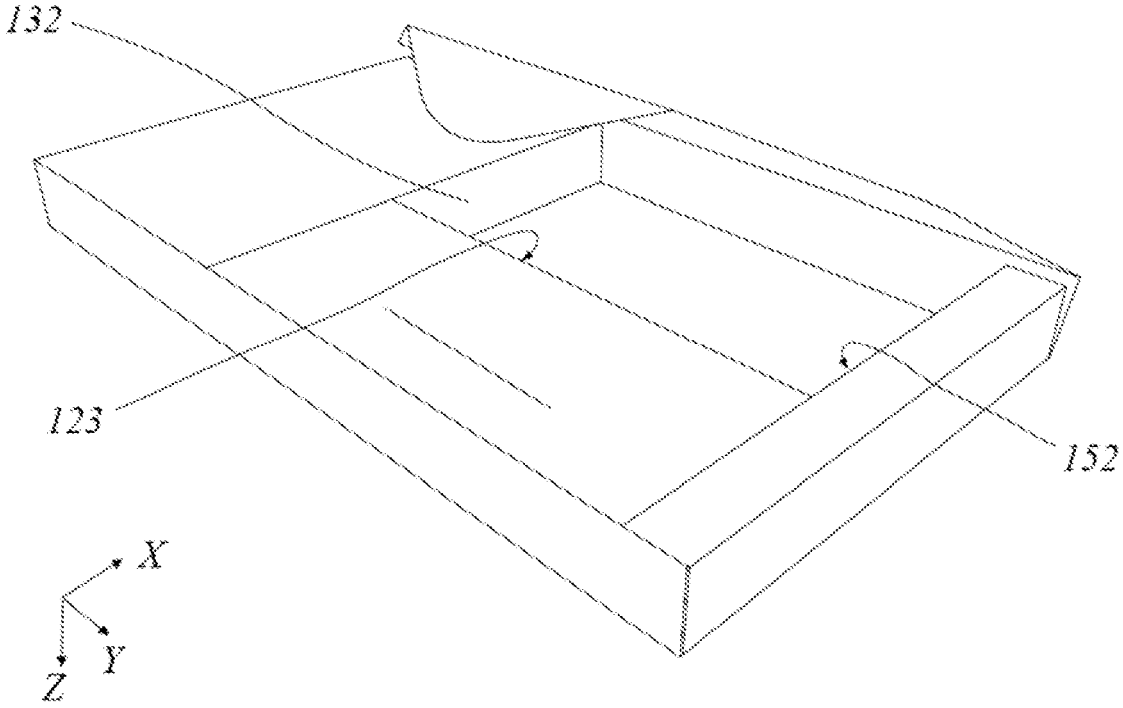
FIG. 7 is another expanded schematic view of the first box body of the packaging box according to some examples of the present disclosure.

FIG. 4 is an expanded schematic view of the packaging box according to some examples of the present disclosure. FIG. 5 is another expanded schematic diagram of the packaging box of some examples of the present disclosure. FIG. 6 is an expanded diagram of the packaging box according to some examples of the present disclosure. FIG. 7 is another expanded diagram of the first box body of the packaging box according to some examples of the present disclosure.

Further, please refer to FIGS. 4 to 7. The sidewall parts include a first bending structure 12, a second bending structure 13, the third bending structure 14 and the fourth bending structure 15, the first bending structure 12 and the third bending structure 14 are respectively bent and connected to the two ends of the first plate body 11 along the first direction X; the second bending structure 13 and the fourth bending structure 15 are bent and connected to the two ends of the first plate body 11 along the second direction Y respectively.

The packaging box in some examples of the present disclosure may be in the form of a cuboid or a cube. Correspondingly, the first box body I can also be a cuboid or a cube. The first bending structure 12 and the second bending structure 13 of the sidewall part. The third bending structure 14 and the fourth bending structure 15 respectively correspond to the four side walls of the packaging box in some examples of the present disclosure. The first bending structure 12 and the third bending structure 14 are respectively bent and connected to the two ends of the first plate body 11 along the first direction X. That is to say, the first bending structure 12 and the third bending structure 14 will be bent to form a set of opposing side walls of the first box body 1. The second bending structure 13 and the fourth bending structure 15 are respectively bent and connected to two ends of the first plate body 11 along the second direction Y. That is to say, the second bending structure 13 and the fourth bending structure 15 be bent to form another set of opposite side walls of the first box body 1. The first bending structure 12, the second bending structure, the third bending structure 14, the fourth bending structure 15 and the first plate body 11 are bent together to form the first box body 1.

Further, continuing to refer to FIGS. 4 to 7 the first bending structure 12 includes, a first side plate 121, a first cover plate 122, a second side plate 123 and a second cover plate 124 being sequentially in bending connection; the first side plate 121 is in bending connection with the first plate body 11; in the first state, the first side plate 121 is parallel to the third direction Z, and the first cover plate 122, the second cover 124 and the second side plate 123 are coplanar and parallel to the first direction X; in the second state, the first side plate 121 and the second side plate 123 are both parallel to the third direction Z, and the first cover plate 122 and the second cover plate 124 are both parallel to the first direction X, and the second cover plate 124 is in contact with a side of the first plate body 11 close to the first cover plate 122.

The first side plate 121, the first cover plate 122, the second side plate 123 and the second cover plate 124 of the first bending structure 12 are bent and connected in sequence, and the first side plate 121 and the first plate body 11 are bent and connected. In the first state and the second state, the first side plate 121 is parallel to the third direction Z, forming an outer wall of the first box body 1.

In the first state, the first cover plate 122, the second cover plate 124 and the second side plate 123 are coplanar and jointly form a part of the cover of the first box body 1. Since the first cover plate 122, the second cover plate 124 and the second side plate 123 are coplanar, the internal space of the first box body 1 is completely opened, ensuring that the first box body 1 has a large space capacity to accommodate the second box body 2.

In the second state, the second side plate 123 and the second cover plate 124 are bent relative to the first cover plate 122. The first cover plate 122 still forms part of the cover of the first box body 1. Considering that the second box body 2 has been taken out of the first box body 1, the first box body 1 is in a hollow state. The second cover plate 124 is in contact with the inside of the first plate body 11 such that it can support the first box body 1 and maintain the structural stability of the first box body 1. The second side plate 123 is parallel to the third direction Z, forming an inner wall of the accommodation space at the first opening 111, limiting the size of the accommodation space corresponding to the first opening 111 to ensure that the first opening 111 can fully display the packaged items.

Further, continuing to refer to FIGS. 4 to 7, the third bending structure 14 includes a third side plate 141 and the third cover plate 142; the third side plate 141 is bent and connected to the first plate body 11; the third side plate 141 is parallel to the third direction Z, the third cover plate 142 is parallel to the first direction X; the first cover plate 122 is provided with a first socket 125 and the third cover plate 142 is provided with a first tongue 143 that is inserted into the first socket 125.

The third side plate 141 and the third cover plate 142 of the third bending structure 14 are connected in sequence, and the third side plate 141 is connected to the first plate body 11 by bending. In the first state and the second state, the third side plate 141 is parallel to third direction Z, forming an outer wall of the first box body 1. Besides, the third cover 142 is parallel to the first direction X, forming part of the cover of the first box body 1.

The first socket 125 of the first cover plate 122 is inserted into the first tongue 143 of the third cover plate 142, so as to lock the packaging box of some examples of the present disclosure and reduce the risk of the packaging box of some examples of the present disclosure being accidentally opened. When the second box body 2 is taken out of the first box body 1, the insertion of first tongue 143 and the first socket 125 is released and the first box body I can be opened. After the second box body 2 is taken out, the first tongue 143 is inserted again into the first socket 125 and the first box body 1 is closed.

Further, continuing to refer to FIGS. 4 to 7, the second bending structure 13 includes a fourth side plate 131, the fourth cover plate 133, the fifth side plate 132 and the fifth cover plate 134 that are bent and connected; the fourth side plate 131 is bent and connected to the first box body 11; the fifth side plate 132 is provided with a first slot 135; the first bending structure 12 is provided with a second slot 126, part of the second slot 126 is located on the first cover plate 122, and part of the second slot 126 is located on the second side plate 123. In the first state, the fourth side plate 131 is parallel to the third direction Z, and the fourth cover plate 133, the fifth cover plate 134 and the fifth side plate 132 are coplanar and parallel to the first direction X; in the second state, the fourth side plate 131 and the fifth side plate 132 are both parallel to the third direction Z, and the fourth cover plate 133 and the fifth cover plate 134 are both parallel to the first direction X, the fifth cover plate 134 is in contact with the side of the first plate body 11 close to the fourth cover plate 133, and the first slot 135 and the fifth side plate 132 are inserted into the second slot 126 together.

The fourth side plate 131, the fourth cover plate 133, the fifth side plate 132 and the fifth cover plate 134 of the second bending structure 13 are bent and connected in sequence, and the fourth side plate 131 and the first plate body 11 are bent and connected. In the first state and the second state, the fourth side plate 131 is parallel to the third direction Z, forming an outer wall of the first box body 1.

In the first state, the fourth cover plate 133, the fifth cover plate 134 and the fifth side plate 132 are coplanar and jointly form a part of the cover of the first box body 1. Since the fourth cover plate 133, the fifth cover plate 134 and the fifth side plate 132 are coplanar, the internal space of the first box body 1 is completely opened, ensuring that the first box body 1 has a large space capacity to accommodate the second box body 2.

In the second state, the fifth side plate 132 and the fifth cover plate 134 are bent relative to the fourth cover plate 133. The four cover plate 133 still forms part of the cover of the first box body 1. Considering that the second box body 2 has been taken out of the first box body 1, the first box body 1 is in a hollow state. The fifth cover 134 is in contact with the inside of the first plate body 11 so as to support the first box body 1 and maintain the structural stability of the first box body 1. Fifth side plate 132 is parallel to the third direction Z, forming an inner wall of the accommodation space at the first opening 111, limiting the size of the accommodation space corresponding to the opening 111 to ensure that the first opening 111 can fully display the packaged items.

In addition, the fifth side plate 132 is provided with a first slot 135, and the first bending structure 12 is provided with a second slot 126. Part of the second slot 126 is located on the first cover plate 122, and part of the second slot 126 is located on the second side plate 123. In the second state, the first slot 135 and the fifth side plate 132 are inserted into the second slot 126 together, so that the fifth side plate 132 and the second side plate 123 form a perpendicularly inserted structure, so as to raise the structural stability of the interior walls of the first opening 111 corresponding to the accommodation space.

Further, continuing to refer to FIG. 4 to FIG. 7, the fourth bending structure 15 includes a sixth side plate 151, the sixth cover plate 153, the seventh side plate 152 and the seventh cover plate 154 being in bending connection; the sixth side plate 151 and the first plate body 11 are connected by bending; the seventh side plate 152 is provided with a third slot 155; the first bending structure 12 is provided with a fourth slot 127, part of the fourth slot 127 is located on the first cover plate 122, part of the fourth slot 127 is located on the second side plate 123. In the first state, the sixth side plate 151 is parallel to the third direction Z, and the sixth cover plate 153 and the seventh cover plate 123 and the seventh side plate 152 are coplanar and parallel to the first direction X; in the second state, the sixth side plate 151 and the seventh side plate 152 are both parallel to the third direction Z, and the sixth cover plate 153 and the seventh cover plate 154 are both parallel to the first direction X, the seventh cover plate 154 is in contact with the side of the first plate body 11 close to the sixth cover plate 153, and the third slot 155 and the seventh side plate 152 are inserted into the fourth slot 127 together.

The sixth side plate 151, the sixth cover plate 153, the seventh side plate 152 and the seventh cover plate 154 of the fourth bending structure 15 are bent and connected in sequence, and the sixth side plate 151 and the first plate body 11 are bent and connected. In the first state and the second state, the sixth side plate 151 is parallel to the third direction Z, forming an outer wall of the first box body 1.

In the first state, the sixth cover plate 153, the seventh cover plate 154 and the seventh side plate 152 are coplanar and jointly form a part of the cover of the first box body 1. Since the sixth cover plate 153, the seventh cover plate 154 and the seventh side plate 152 are coplanar, the internal space of the first box body 1 is completely opened, ensuring that the first box body 1 has a large space capacity to accommodate the second box body 2.

In the second state, the seventh side plate 152 and the seventh cover plate 154 are bent relative to the sixth cover plate 153. The six cover plates 153 still forms part of the cover of the first box body 1. Considering that the second box body 2 has been taken out of the first box body 1, the first box body 1 is in a hollow state. The seventh cover 154 is in contact with the inside of the first box body 1 so as to support the first box body 1 and maintain the structural stability of the first box body 1. The seventh side panel 152 is parallel to the third direction Z, forming an inner wall of the accommodation space at the first opening 111, limiting the size of the accommodation space corresponding to the opening 111 to ensure that the first opening 111 can fully display the packaged items.

In addition, the seventh side plate 152 is provided with a third slot 155, and the first bending structure 12 is provided with a fourth slot 127. Part of the fourth slot 127 is located on the first cover plate 122, and part of the fourth slot 127 is located on the second side plate 123. In the second state, the third slot 155 and the seventh side plate 152 are inserted into the fourth slot 127 together, so that the third slot 155 and the seventh side plate 152 and the second side plate 123 form a perpendicularly inserted structure, so as to raise the structural stability of the interior walls of the first opening 111 corresponding to the accommodation space. In the second state, the second side plate 123, the fifth side plate 132, the seventh side plate 152 and the third side plate 141 together form the inner wall of the accommodation space corresponding to the first opening 111. The accommodation space corresponding to the first opening 111 shares the third side plate 141 with the first box body 1.

Figure 8:
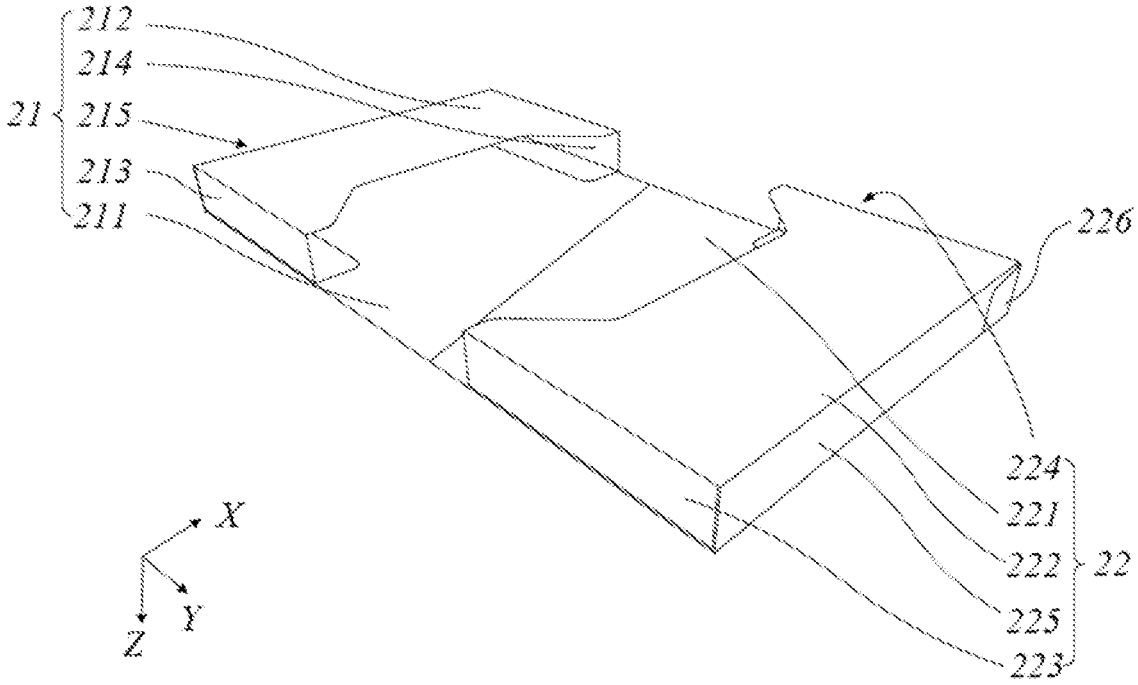
FIG. 8 is a schematic diagram of the second box body of the packaging box according to some examples of the present disclosure.
Figure 9:
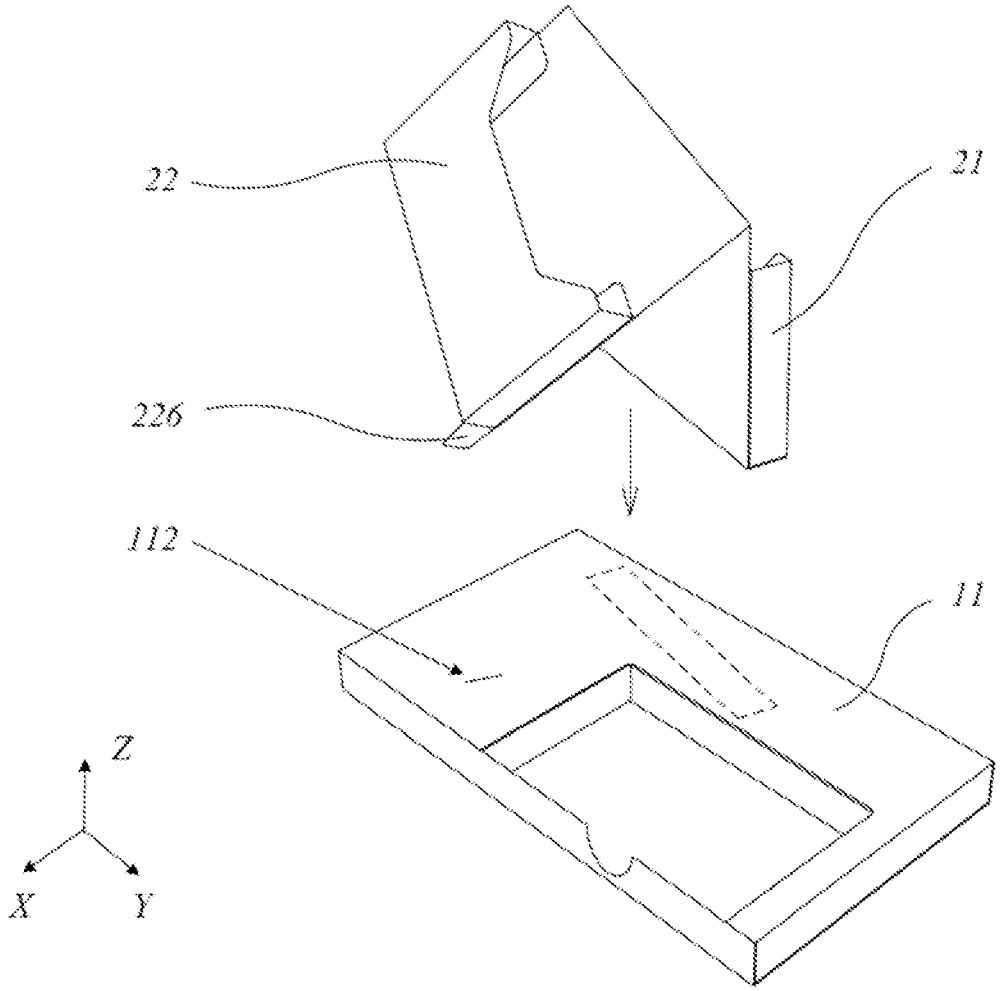
FIG. 9 is an assembly schematic diagram of the packaging box in the second state according to some examples of the present disclosure.

FIG. 8 is a schematic structural diagram of the second box body of the packaging box according to some examples of the present disclosure. FIG. 9 is an assembly schematic diagram of the packaging box in the second state according to some examples of the present disclosure.

Further, please refer to FIGS. 8 and 9. The first receiving part 21 includes a first carrier plate 211, a second carrier plate 212, a first connection plate 213, a second connection plate 214 and a connection plate 215. The first carrier plate 211, the third connection plate 215 and the second carrier plate 212 are bent and connected in sequence, and the first carrier plate 211 is bent and connected to the second receiving part 22; the first connection plate 213 and the second connection plate 214 are respectively bent and connected with two ends of the second carrier plate 212 along the first direction X, and the first connection plate 213 and the second connection plate 214 are respectively fixedly connected with two ends of the first carrier plate 211 along the first direction X, so that the first carrier plate 211, the second carrier plate 212, the first connection plate 213, The second connection plate 214 and the third connection plate 215 form a first accommodation space with an opening; in the second state, the third connection plate 215 is fixedly connected to the first plate body 11.

The first carrier plate 211, the second carrier plate 212, the first connection plate 213, the second connection plate 214 and the third connection plate 215 of the first receiving part 21 together form a first accommodation space with an opening. Third connection plate 215 can be fixedly connected to the first plate body 11 by sticking. The first carrier plate 211, the third connection plate 215 and the second carrier plate 212 are bent and connected in sequence, and the first carrier plate 211 and the second receiving part 22 are bent and connected; The first connection plate 213 and the second connection plate 214 are respectively bent and connected with the two ends of the second carrier plate 212 along the first direction X. The first connection plate 213 and the second connection plate 214 are respectively fixedly connected with two ends of the first carrier plate 211 along the first direction X, so that the first accommodation space forms a cuboid or a part of the cuboid. The opening of the first accommodation space should be toward a side of the first carrier plate 211 connected to the second receiving part 22. In the second state, the first receiving part 21 is bent relative to the second receiving part 22, and both the first receiving part 21 and the second receiving part 22 are in contact with the first plate body 11, and the opening of the first accommodation space can face the side away from the first plate body 11, and it is more convenient for users to take or store packaged items.

Further, continuing to refer to FIGS. 8 and 9, the second receiving part 22 includes a third carrier plate 221, a fourth carrier plate 222, a fourth connection plate 223, a fifth connection plate 224 and a sixth connection plate 225. The third carrier plate 221, the sixth connection plate 225 and the fourth carrier plate 222 are bent and connected in sequence, and the third carrier plate 221 is bent and connected to the first receiving part 21; the fourth connection plate 223 and the fifth connection plate 224 are respectively bent and connected with two ends of the fourth carrier plate 222 along the first direction X, and the fourth connection plate 223 and the fifth connection plate 224 are respectively fixedly connected with two ends of the third carrier plate 221 along the first direction X, so that the third carrier plate 221, the fourth carrier plate 222, the fourth connection plate 223, The fifth connection plate 224 and the sixth connection plate 225 form a second accommodation space with an opening; the fifth connection plate 224 is provided with a second tongue 226, and the first plate body 11 is provided with a second socket 112; in the second state, the second tongue 226 is inserted into the second socket 112.

The third carrier plate 221, the fourth carrier plate 222, the fourth connection plate 223, and the fifth connection plate 224 and the sixth connection plate 225 of the second receiving part 22 together form a second accommodation space with an opening. The third carrier plate 221, the sixth connection plate 225 and the fourth carrier plate 222 are bent and connected in sequence, and the third carrier plate 221 is bent and connected to the first receiving part 21; the fourth connection plate 223 and the fifth connection plate 224 are respectively bent and connected with two ends of the fourth carrier plate 222 along the first direction X, and the fourth connection plate 223 and the fifth connection plate 224 are respectively fixedly connected with two ends of the third carrier plate 221 along the first direction X, so that the second accommodation space forms a cuboid or a part of the cuboid. The opening of the second accommodating space should face the side of the third carrier plate 221 connected to the first receiving part 21. In the second state, the first receiving part 21 is bent relative to the second receiving part 22, and the first receiving part 21 and the second receiving part 22 are both connected to the first plate body 11, and the opening of the second accommodation space can face a side away from the first plate body 11, making it easier for users to take or store packaged items.

The switching process of the packaging box from the first state to the second state in some examples of the present disclosure is as follows:

Open the first box body 1 and take out the second box body 2. Bend the first bending structure 12, the second bending structure 13, the third bending structure 14 and the fourth bending structure 15 of the first box body 1. The specific bending method has been described in the above examples and will not be described again here. For the second box body 2, bend the first carrier plate 211 and the third carrier plate 221, so that the orientations of the first receiving part 21 and the second receiving part 22 are close to each other. At this time, the first receiving part 21 is located on the side of the third connection plate 215 away from the sixth connection plate 225, and the second receiving part 22 is located on the side of the third connection plate 215 away from the sixth connection plate 225, both of which has substantially the same orientation. Then the third connection plate 215 is bonded to the first plate body 11 of the first box body 1, and at the same time, the second tongue 226 is inserted into the second socket 112 of first plate body 1, so that the packaging box of some examples of the present disclosure is in the second state. At this time, the third connection plate 215 is bonded with the first plate body 11, and the second tongue 226 is inserted into the second socket 112, and they work together to fix the relative position between the first box body 1 and the second box body 2, so that the packaging box of some examples of the present disclosure can remain stable in the second state.

Figure 10:
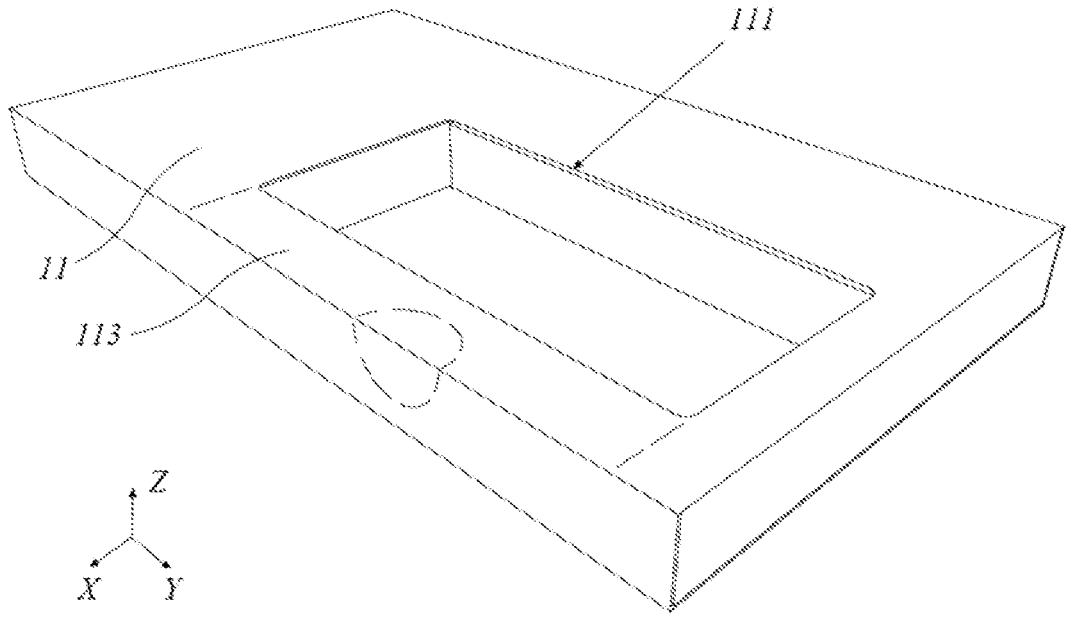
FIG. 10 is a structural representation of the first box body of the packaging box in the second state according to some examples of the present disclosure.

FIG. 10 is a structural representation of the first box body of the packaging box in the second state according to some examples of the present disclosure. picture.

Further, please refer to FIG. 10. A tearing portion 113 is provided at the first opening 111. In the first state, the tearing portion 113 is disposed at the first opening 111. The tearing portion 113 at least partially blocks the first opening 111.

In the first state, the tearing part 113 is not torn off from the first plate body 11, and the tearing part 113 blocks the first opening 111, reducing the risk of damage to the second inner box at the first opening 111. In the second state, the tearing portion 113 is torn off from the bottom of the first plate body 11, so that the first opening 111 is exposed, so that the user can take out or store the packaged items through the first opening 111. In the second state, the tearing portion 113 can also be bent toward the inside of the first opening 111 to expose the first opening 111. It should be noted that the size of the packaged item should be less than or equal to the size of the first opening 111, so that the packaged item can be taken out from the first opening 111 smoothly.

Figure 11:
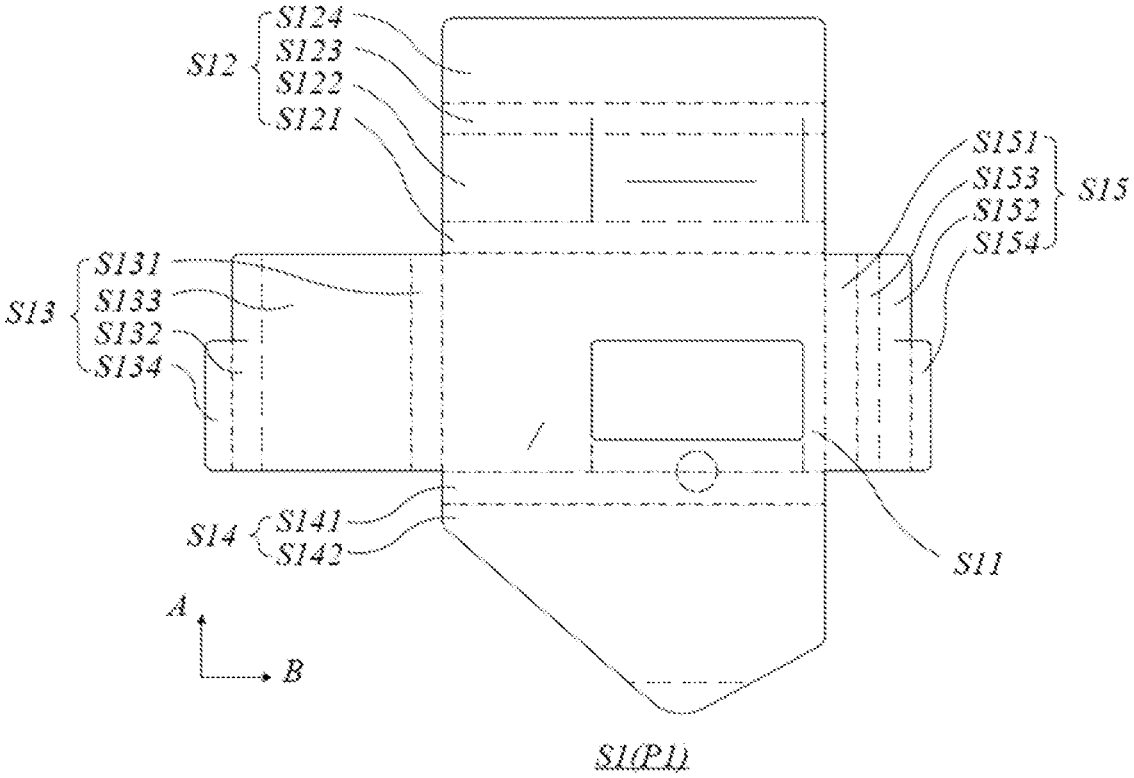
FIG. 11 is a schematic diagram of the first side of the first sub-board of the cardboard structure according to some examples of the present disclosure.
Figure 12:
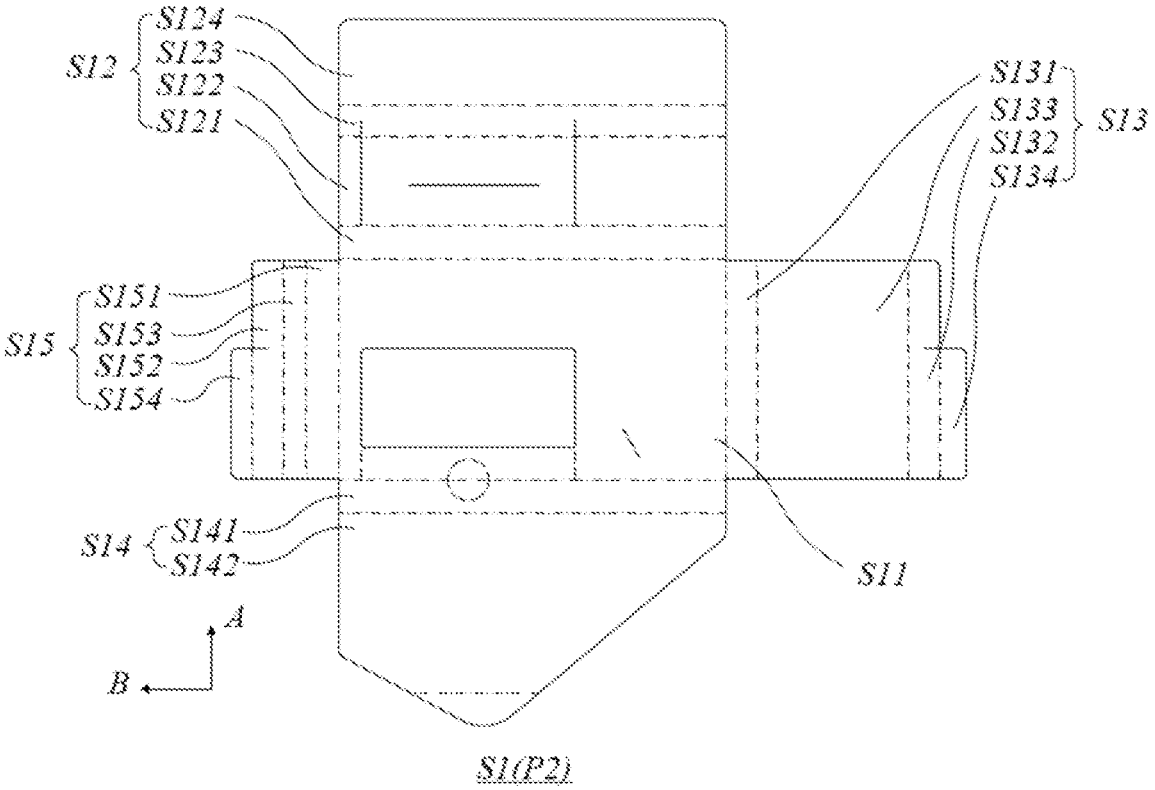
FIG. 12 is a schematic view of the second side of the first sub-board of the cardboard structure according to some examples of the present disclosure.
Figure 13:
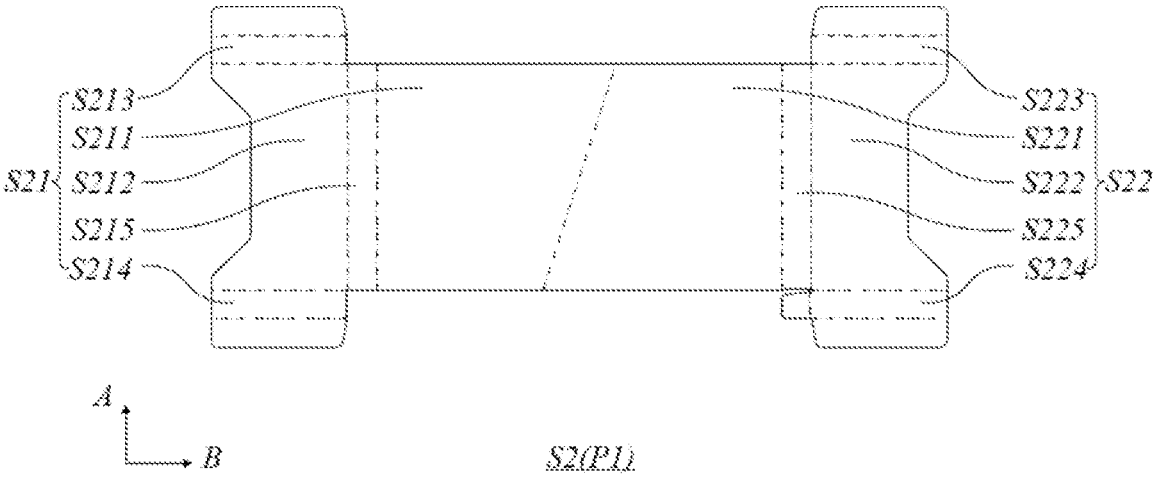
FIG. 13 is a schematic view of the first side of the second sub-board of the cardboard structure according to some examples of the present disclosure.
Figure 14:
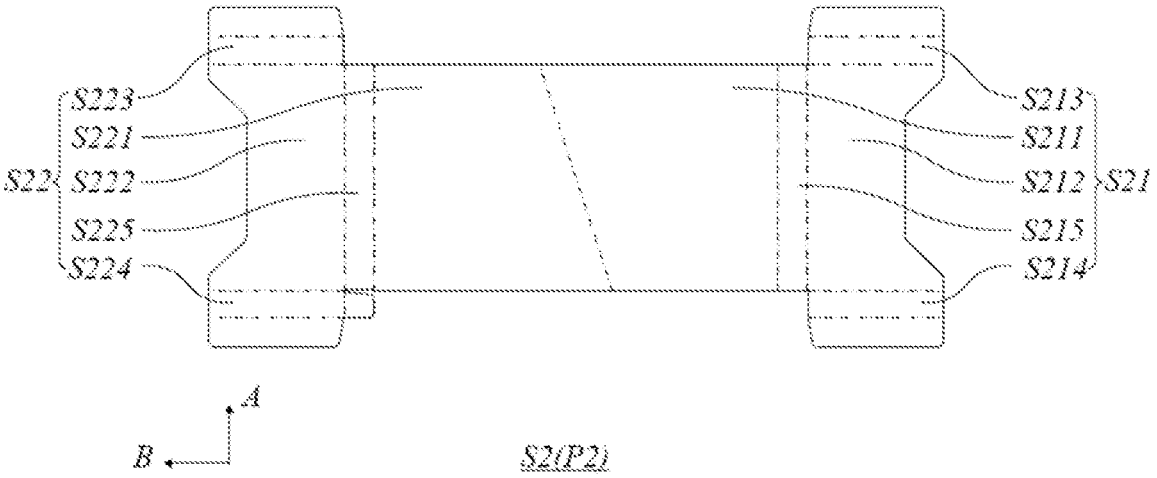
FIG. 14 is a schematic view of the second side of the second sub-board of the cardboard structure according to some examples of the present disclosure.

FIG. 11 is a schematic diagram of the first side of the first sub-board of the cardboard structure according to some examples of the present disclosure. FIG. 12 is a schematic view of the second side of the first sub-board of the cardboard structure according to some examples of the present disclosure. FIG. 13 is a schematic view of the first side of the second sub-board of the cardboard structure according to some examples of the present disclosure. FIG. 14 is a schematic view of the second side of the second sub-board of the cardboard structure according to some examples of the present disclosure.

Referring to FIGS. 11 to 14, examples of the present disclosure provide a cardboard structure, including: a first surface P1 and a second surface P2 that is opposite to the first surface; a first sub-board S1 is bent to form a first box body 1, comprising a first plate area S11 and a plurality of sidewall areas; the first plate area S11 along a first reference direction A and a second reference direction B are respectively connected to the plurality of the sidewall areas; the first plate area S11 is provided with a first opening 111; the sidewall area is bent at least toward the first surface P1 relative to the first plate area S11 to form a first plate body 11 and sidewall parts; the first reference direction A and the second reference direction B are perpendicular; a second sub-board S2 is bent to form a second box body 2, comprising a first accommodating area S21 and a second accommodating area S22 mutually connected, and the first accommodating area S21 is bent to form a first receiving part 21, and the second accommodating area S22 is bent to form a second receiving part 22. In a first state, the second box body 2 is located inside the first box body 1, blocking the first opening 111; in a second state, the first receiving part 21 and the second receiving part 22 of the second box body 2 are respectively connected to outside of the first plate body, exposing an inner portion of the first box body 1 through the first opening 111.

The cardboard structure of some examples of the present disclosure can be bent to form the packaging box of some examples of the present disclosure.

Since the cardboard structure can be regarded as a planar structure when it is not bent, the two sides of the planar structure are the first surface P1 and the second surface P2 respectively. It should be noted that when bending the cardboard structure, bent towards the first surface P1, which means that two parts of first surface P1 are bent relative to each other form an angle of less than 180°, the second face P2 forms an angle greater than 180°. Correspondingly, bending toward the second surface P2 means that two parts of the second surface P2 form an angle less than 180°, and the first surface P1 forms an angle greater than 180°. In addition, the cardboard structure is in a planar state, the first reference direction A can be the perpendicular direction, and the second reference direction B can be horizontal direction. The cardboard structure can be bent to obtain a packaging box. The shape of the packaging box is not limited. For convenience of explanation, a cuboid box is used as an example.

The first sub-board S1 is bent to form the first box body 1. The first sub-board S1 includes a first plate area S11 and a plurality of sidewall areas. Multiple sidewall areas are bent toward the first surface P1 relative to the first plate area S11 to form the first plate body 11 and multiple sidewall parts. The sidewall area includes a first bending area S12, a second bending area S13, a third bending area S14 and a fourth bending area S15. The first bending area S12 includes a first side area S121, a first cover area S122, the second side area S123 and the second cover area S124 connected in sequence. The second bending area S13 includes a fourth side area S131, a fourth cover area S133, a fifth side area S132 and a fifth cover area S134 connected in sequence. The third bending area S14 includes a third side area S141 and a third cover area S142 connected in sequence. The fourth bending area S15 includes a sixth side area S151, a sixth cover area S153, a seventh side area S152 and a seventh cover area S154 connected in sequence. The first side area S121 and the third side area S141 are respectively connected to two ends of the first plate area S11 along the first reference direction A, and the fourth side area S131 and the sixth side area S151 are respectively connected to two ends of the first plate area S11 along the second reference direction B.

The second sub-board S2 is bent to form the second box body 2. The second sub-board S2 includes a first accommodating area S21 and a second accommodating area S22. The first accommodating area S21 includes a first carrier area S211, a second carrier area S212, a first connection area S213, second connection area S214 and third connection area S215. The first carrier area S211 and the third connection area S215 are sequentially connected to the second carrier area S212, and the first carrier area S211 is connected to the second accommodating area S22. The second accommodating area S22 includes a third carrier area S221, a fourth carrier area S222, a fourth connection area S223, and a fifth connection area S224. and a sixth connection area S225. The third carrier area S221, the sixth connection area S225 and the fourth carrier area S222 are connected in sequence. The third carrier area S221 is connected with the first accommodating area S21.

When the packaging box formed by bending the cardboard structure according to some examples of the present disclosure is in the first state, the first side area S121, the third side area S141, the fourth side area S131 and the sixth side area S151 are facing towards the first surface P1 direction relative to first plate area S11. The first cover area S122 is bent toward the first surface P1 relative to the first side area S121. The second side area S123 and the second cover area S124 are not bent relative to the first cover area S122. The third cover area S142 is bent toward the first surface P1 direction relative to the third side area S141. The fourth cover area S133 is bent toward the first surface P1 direction relative to the fourth side area S131, and the fifth side area S132 and the fifth cover area S134 are not bent relative to the fourth cover area S133. The sixth cover area S153 is bent toward the first surface P1 direction relative to the sixth side area S151, and the seventh side area S152 and the seventh cover area S154 are not bent relative to the sixth cover area S153.

At the same time, the first carrier area S211 is not bent relative to the third carrier area S221. The first carrier area S221, the third connection area S215 and the second carrier area S212 are bent in sequence toward the first surface P1 direction, and the first connection area S213 and the second connection area S214 are both bent toward the first surface P1 direction relative to the first carrier area S211. The third carrier area S221, the sixth connection area S225 and the fourth carrier area S222 are bent toward the first surface P1 direction in sequence, and the fourth connection area S223 and the fifth connection area S224 are both bent toward the first surface P1 direction relative to the third carrier area S221.

When the packaging box formed by bending the cardboard structure according to some examples of the present disclosure is in the second state, the first side area S121, the third side area S141, the fourth side area S131 and the sixth side area S151 are bent towards the first surface P1 direction relative to the first plate area S11. The first cover area S122 is bent toward the first surface P1 direction relative to the first side area S121. The first cover area S122, the second side area S123 and the second cover area S124 are sequentially bent toward the first surface P1 direction. The third cover area S142 is bent toward the first surface P1 direction relative to the third side area S141. The fourth cover area S133 is bent toward the first surface P1 direction relative to the fourth side area S131. The fourth cover area S133, the fifth side area S132 and the fifth cover area S134 are sequentially bent toward the first surface P1 direction. The sixth cover area S153 is bent towards the first surface P1 direction relative to the sixth side area S151, and the sixth cover area S153, the seventh side area S152 and the seventh cover area S154 are sequentially bent toward the first surface P1 direction relative to the sixth cover area S153.

At the same time, the first carrier area S211 is bent toward the second surface P2 relative to the third carrier area S221. The first carrier area S211, the third connection area S215 and the second carrier area S212 are bent toward the first surface P1 in sequence. The first connection area S213 and the second connection area S214 are both bent toward the first surface P1 direction relative to the first carrier area S211. The third carrier area S221, the sixth connection area S225 and the fourth carrier area S222 are bent in sequence toward the first surface P1 direction. The fourth connection area S223 and the fifth connection area S224 are both bent toward the first surface P1 direction relative to the third carrier area S221.

To sum up, examples of the present disclosure provide a packaging box and cardboard structure. The structures of the first box body and the second box body are different in the first state and the second state; in the first state, the second box is located in the first box, the packaged items can be placed in the second box to provide double protection and cushioning for the packaged items; in the second state, the second box body is bent and connected to the outside of the first box body, and all of the first opening, the first receiving part and the second receiving part can display the packaged items while making it convenient for users to take out and store them. Therefore, the packaging box of examples of the present disclosure can be used in a variety of scenarios, expanding the scope of deformable packaging. The application scope of the box makes the packaging box easier to reuse and more environmentally friendly.

The above are only preferred examples of the present disclosure, and are not intended to limit the patent scope of the present disclosure. Equivalent structures or equivalent process transformations made using the contents of this disclosure description and drawings, or directly or indirectly used in other related technical fields, they are all equally included in the scope of patent protection of this disclosure.

What is claimed is:

1. A packaging box, comprising:

a first box body comprising a first plate body and a plurality of sidewall parts, wherein the first plate body comprises a first opening, two ends of the first plate body along a first direction and two ends of the first plate body along a second direction are respectively connected with the plurality of the sidewall parts, a portion of the sidewall parts parallels to a third direction, wherein the first direction, the second direction and the third direction are mutually perpendicular; and a second box body comprising a first receiving part in bending connection with a second receiving part, wherein the packaging box has a first state and a second state, wherein in the first state, the second box body is located inside the first box body and blocks the first opening, and wherein in the second state, the first receiving part and the second receiving part are respectively connected to an outside of the first plate body and an inner portion of the first box body is exposed through the first opening.

2. The packaging box of claim 1, wherein the plurality of sidewall parts comprise a first bending structure, a second bending structure, a third bending structure and a fourth bending structure; and wherein the first bending structure and the third bending structure are respectively bendably connected to the two ends of the first plate body along the first direction, the second bending structure and the fourth bending structure are respectively bent and connected to the two ends of the first plate body along the second direction.

3. The packaging box of claim 2, wherein the first bending structure comprises a first side plate, a first cover plate, a second side plate and a second cover plate being sequentially in bending connection; and the first side plate is in bending connection with the first plate body;

wherein in the first state, the first side plate is parallel to the third direction, and the first cover plate and the second cover plate and the second side plate are coplanar and parallel to the first direction; in the second state, the first side plate and the second side plate are parallel to the third direction, the first cover plate and the second cover plate are parallel to the first direction, and the second cover plate is in contact with a side of the first plate body close to the first cover plate.

4. The packaging box of claim 3, wherein the third bending structure comprises a third side plate and a third cover plate that are in bending connection; the third side plate is in bending connection with the first plate body; the third side plate is parallel to the third direction; and the third cover plate is parallel to the first direction; and wherein the first cover plate comprises a first socket, and the third cover plate comprises a first tongue inserted into the first socket.

5. The packaging box of claim 3, wherein the second bending structure comprises a fourth side plate, a fourth cover plate, a fifth side plate and a fifth cover plate that are in bending connection; and the fourth side plate is in bending connection with the first plate body;

wherein the fifth side panel comprises a first slot, the first bending structure comprises a second slot, a first part of the second slot is located on the first cover plate, and a second part of the second slot is located on the second side plate; and wherein in the first state, the fourth side plate is parallel to the third direction, and the fourth cover plate, the fifth cover plate and the fifth side plate are coplanar and parallel to the first direction; in the second state, the fourth side plate and the fifth side plate are both parallel to the third direction, the fourth cover plate and the fifth cover plate are both parallel to the first direction, the fifth cover plate is in contact with a side of the first plate body close to the fourth cover plate, and the first slot and the fifth side plate are both inserted into the second slot.

6. The packaging box of claim 3, wherein the fourth bending structure comprises a sixth side plate, a sixth cover plate, a seventh side plate and a seventh cover plate that are sequentially in bending connection; and the sixth side plate is in bending connection with the first plate body;

wherein the seventh side plate is provided with a third slot, the first bending structure comprises a fourth slot, a first part of the fourth slot is located on the first cover plate, and a second part of the fourth slot is located on the second side plate;

wherein in the first state, the sixth side plate is parallel to the third direction, and the sixth cover plate, the seventh cover plate and the seventh side plate are coplanar and parallel to the first direction; in the second state, the sixth side plate and the seventh side plate are both parallel to the third direction, and the sixth cover plate and the seventh cover plate are both parallel to the first direction, the seventh cover plate is in contact with a side of the first plate body close to the sixth cover plate, and the third slot and the seventh side plate are both inserted into the fourth slot.

7. The packaging box of claim 1, wherein the first receiving part includes a first carrier plate, a second carrier plate, a first connection plate, a second connection plate and a third connection plate;

wherein the first carrier plate, the third connection plate and the second carrier plate are sequentially in bending connection, and the first carrier plate is in bending connection with the second receiving part;

wherein the first connection plate and the second connection plate are respectively in bending connection with two ends of the second carrier plate along the first direction, and the first connection plate and the second connection plate are respectively fixedly connected to two ends of the first carrier plate along the first direction, so that the first carrier plate, the second carrier plate, the first connection plate, the second connection plate and the third connection plate form a first accommodation space with an opening; and wherein in the second state, the third connection plate is fixedly connected to the first plate body.

8. The packaging box of claim 1, wherein the second receiving part comprises a third carrier plate, a fourth carrier plate, a fourth connection plate, a fifth connection plate and a sixth connection plate, wherein the third carrier plate, the sixth connection plate and the fourth carrier plate are sequentially in bending connection, and the third carrier plate is in bending connection with the first receiving part;

the fourth connection plate and the fifth connection plate are respectively in bending connection with two ends of the fourth carrier plate along the first direction, and the fourth connection plate and the fifth connection plate are respectively fixedly connected with two ends of the third carrier plate along the first direction, so that the third carrier plate, the fourth carrier plate, the fourth carrier plate, the fifth connection plate and the sixth connection plate form a second accommodation space with an opening; the fifth connection plate comprises a second tongue, and the first plate body comprises a second socket; and wherein in the second state, the second tongue is inserted into the second socket.

9. The package box of claim 8, wherein further in the second state, the first receiving part is bent relative to the second receiving part, and the first receiving and the second receiving part are both connected to the first plate body, so that the opening of the second accommodate space face a side away from the first plate body.

10. The packaging box of claim 1, wherein the first opening comprises a tearing portion, and wherein in the first state, the tearing portion at least partially blocks the first opening.

11. The packaging box of claim 9, wherein in the second state, the tearing portion is torn off from the bottom of the first plate body to expose the first opening; or the tearing portion is bent toward the inside of the first opening to expose the first opening.

12. A cardboard structure, comprising:

a first sub-board configured to be bent to form a first box body, the first sub-board comprising a first surface, a second surface that is opposed to the first surface, a first plate area comprising a first opening, and a plurality of sidewall areas, wherein the first plate area along a first reference direction and a second reference direction is respectively connected to the plurality of sidewall areas, wherein the plurality of sidewall areas are configured to be bent at least toward the first surface relative to the first plate area to form a first plate body and sidewall parts of the first box body, and wherein the first reference direction and the second reference direction are perpendicular; and a second sub-board configured to be bent to form a second box body, the second sub-board comprising a first accommodating area and a second accommodating area mutually connected, wherein the first accommodating area is configured to be bent to form a first receiving part of the second box body, and wherein the second accommodating area is configured to be bent to form a second receiving part of the second box body, wherein in a first state, the second box body formed from the second sub-board is configured to be located inside the first box body formed from the first sub-board and is configured to block the first opening, and wherein in a second state, the first receiving part of the second box body formed from the second sub-board and the second receiving part of the second box body formed from the second sub-board are configured to be respectively connected to an outside of the first plate body of the first box body formed from the first sub-board such that an inner portion of, and the first box body formed from the first sub-board is configured to be exposed through the first opening.

13. The cardboard structure of claim 12, wherein the plurality of sidewall areas comprise a first bending area, a second bending area, a third bending area and a fourth bending area, the first bending area comprises a first side area, a first cover area, a second side area and a second cover area connected in sequence; and wherein the second bending area comprises a fourth side area, a fourth cover area, a fifth side area and a fifth cover area connected in sequence, the third bending area comprises a third side area and a third cover area connected in sequence, the fourth bending area comprises a sixth side area, a sixth cover area, a seventh side area and a seventh cover area connected in sequence, the first side area and the third side area are respectively connected to two ends of the first plate area along the first reference direction, and the fourth side area and the sixth side area are respectively connected to two ends of the first plate area along the second reference direction.

14. The cardboard structure of claim 13, wherein the first accommodating area comprises a first carrier area, a second carrier area, a first connection area, a second connection area and a third connection area, the first carrier area and the third connection area are sequentially connected to the second carrier area, and the first carrier area is connected to the second accommodating area, wherein the second accommodating area comprises a third carrier area, a fourth carrier area, a fourth connection area, and a fifth connection area and a sixth connection area, the third carrier area, the sixth connection area and the fourth carrier area are connected in sequence, the third carrier area is connected with the first accommodating area.

15. The cardboard structure of claim 14, wherein in the first state, the first side area, the third side area, the fourth side area and the sixth side area are facing towards the first surface relative to the first plate area;

wherein the first cover area is configured to be bent toward the first surface relative to the first side area, the second side area and the second cover area are configured to be not bent relative to the first cover area, the third cover area is configured to be bent toward the first surface relative to the third side area, the fourth cover area is configured to be bent toward the first surface relative to the fourth side area, and the fifth side area and the fifth cover area are configured to be not bent relative to the fourth cover area; and wherein the sixth cover area is configured to be bent toward the first surface relative to the sixth side area, and the seventh side area and the seventh cover area are configured to be not bent relative to the sixth cover area.

16. The cardboard structure of claim 15, wherein further in the first state, the first carrier area is configured to be not bent relative to the third carrier area, the first carrier area, the third connection area and the second carrier area are configured to be bent in sequence towards the first surface, and the first connection area and the second connection area are configured to be bent toward the first surface relative to the first carrier area; and wherein the third carrier area, the sixth connection area and the fourth carrier area are configured to be bent towards the first surface in sequence, and the fourth connection area and the fifth connection area are configured to be bent towards the first surface relative to the third carrier area.

17. The cardboard structure of claim 14, wherein in the second state, the first side area, the third side area, the fourth side area and the sixth side area are configured to be bent towards the first surface relative to the first plate area;

wherein the first cover area is configured to be bent toward the first surface relative to the first side area, the first cover area, the second side area and the second cover area are sequentially configured to be bent toward the first surface, the third cover area is configured to be bent toward the first surface relative to the third side area, the fourth cover area is configured to be bent toward the first surface relative to the fourth side area, the fourth cover area, the fifth side area and the fifth cover area are configured to be bent in sequence toward the first surface; and wherein the sixth cover area is configured to be bent towards the first directionfirst surface relative to the sixth side area, and the sixth cover area, the seventh side area and the seventh cover area are configured to be bent in sequence toward the first surface relative to the sixth cover area.

18. The cardboard structure of claim 17, wherein further in the second state, the first carrier area is configured to be bent relative to the third carrier area and toward the second surface that is opposite to the first surface; and wherein the first carrier area, the third connection area and the second carrier area are configured to be bent in sequence toward the first surface, the first connection area and the second connection area are configured to be bent toward the first surface relative to the first carrier area, the third carrier area, the sixth connection area and the fourth carrier area are configured to be bent in sequence toward the first surface, the fourth connection area and the fifth connection area are configured to be bent toward the first surface relative to the third carrier area.

* * * * *